US010393077B2

(12) United States Patent
Furuhashi et al.

(10) Patent No.: US 10,393,077 B2
(45) Date of Patent: Aug. 27, 2019

(54) FUEL PUMP

(71) Applicant: DENSO CORPORATION, Kariya, Aichi-pref. (JP)

(72) Inventors: Daiji Furuhashi, Kariya (JP); Hiromi Sakai, Kariya (JP)

(73) Assignee: DENSO CORPORATION, Kariya (JP)

( * ) Notice: Subject to any disclaimer, the term of this patent is extended or adjusted under 35 U.S.C. 154(b) by 211 days.

(21) Appl. No.: 15/551,661

(22) PCT Filed: Mar. 24, 2016

(86) PCT No.: PCT/JP2016/001714
§ 371 (c)(1),
(2) Date: Aug. 17, 2017

(87) PCT Pub. No.: WO2016/166936
PCT Pub. Date: Oct. 20, 2016

(65) Prior Publication Data

US 2018/0038326 A1 Feb. 8, 2018

(30) Foreign Application Priority Data

Apr. 14, 2015 (JP) ..... 2015-082663

(51) Int. Cl.
*F03C 2/00* (2006.01)
*F03C 4/00* (2006.01)
(Continued)

(52) U.S. Cl.
CPC ..... *F02M 37/08* (2013.01); *F02M 37/10* (2013.01); *F04C 2/10* (2013.01); *F04C 2/102* (2013.01);
(Continued)

(58) Field of Classification Search
CPC ..... F04C 2/102; F04C 2/084; F04C 2/086; F04C 14/10; F04C 23/008; F04C 15/0049;
(Continued)

(56) References Cited

U.S. PATENT DOCUMENTS

2003/0026722 A1 2/2003 Takagi et al.
2008/0112821 A1 5/2008 Morris
(Continued)

FOREIGN PATENT DOCUMENTS

JP 6-123288 5/1994
JP 2011-149317 8/2011

OTHER PUBLICATIONS

International Search Report for PCT/JP2016/001714, dated Jun. 28, 2016, 2 pages.

*Primary Examiner* — Theresa Trieu
(74) *Attorney, Agent, or Firm* — Nixon & Vanderhye P.C.

(57) ABSTRACT

A fuel pump includes: an outer gear; an inner gear that is meshed with the outer gear and includes a receiving hole; a rotatable shaft; a contact portion that is formed to be contactable with the receiving hole; and a pump housing that rotatably receives the outer gear and the inner gear and includes a first housing component and a second housing component, between which the inner gear is held in the axial direction. At least one of the receiving hole and the contact portion includes a tilt surface, which is tilted relative to the axis direction. When the rotatable shaft is rotated to a drive rotation side, the receiving hole contacts the contact portion through the tilt surface, so that the receiving hole is urged in a circumferential direction and is also urged toward the first housing component in the axial direction.

5 Claims, 8 Drawing Sheets

(51) Int. Cl.

| | |
|---|---|
| ***F04C 2/00*** | (2006.01) |
| ***F04C 18/00*** | (2006.01) |
| ***F02M 37/08*** | (2006.01) |
| ***F02M 37/10*** | (2006.01) |
| ***F04C 2/10*** | (2006.01) |
| ***F04C 14/10*** | (2006.01) |
| ***F04C 15/00*** | (2006.01) |

(52) U.S. Cl.
CPC ..... *F04C 14/10* (2013.01); *F04C 15/00* (2013.01); *F04C 15/0065* (2013.01); *F04C 15/0076* (2013.01); *F04C 2210/203* (2013.01); *F04C 2270/16* (2013.01)

(58) Field of Classification Search
CPC ..... F04C 15/0023; F04C 15/0065; F04C 15/0073; F04C 15/0076; F04C 2210/1044; F04C 2210/203; F04C 2240/20; F04C 2240/60; F04C 2270/16; F02M 37/08; F02M 37/10
USPC ..... 418/15, 71, 166, 171, 131–133
See application file for complete search history.

(56) References Cited

U.S. PATENT DOCUMENTS

| | | | | |
|---|---|---|---|---|
| 2016/0298624 | A1* | 10/2016 | Sakai | F04C 2/102 418/171 |
| 2016/0305425 | A1* | 10/2016 | Sakai | F04C 2/102 418/171 |
| 2016/0305426 | A1* | 10/2016 | Sakai | F04C 2/102 418/171 |
| 2018/0010606 | A1* | 1/2018 | Sakai | F04C 2/102 418/171 |

* cited by examiner

FUEL PUMP

CROSS REFERENCE TO RELATED APPLICATION

This application is the U.S. national phase of International Application No. PCT/JP2016/001714 filed Mar. 24, 2016, which designated the U.S. and claims priority to Japanese Patent Application No. 2015-82663 filed on Apr. 14, 2015, the entire contents of each of which are hereby incorporated by reference.

TECHNICAL FIELD

The present disclosure relates to a fuel pump that sequentially draws fuel into pump chambers and thereafter sequentially discharges the fuel from the pump chambers.

BACKGROUND ART

There is known a fuel pump that sequentially draws fuel into pump chambers and thereafter sequentially discharges the fuel from the pump chambers. A fuel pump disclosed in the patent literature 1 includes: an outer gear that includes a plurality of internal teeth; an inner gear that includes a plurality of external teeth and is meshed with the outer gear while the inner gear is eccentric to the outer gear in an eccentric direction, wherein the inner gear includes a receiving hole that extends in an axial direction; a rotatable shaft that is rotationally driven; a contact portion that is formed to be contactable with the receiving hole, wherein the contact portion transmits a drive force from the rotatable shaft to the receiving hole to rotate the inner gear; and a pump housing that rotatably receives the outer gear and the inner gear. The pump housing includes a first housing component and a second housing component, between which the inner gear is held in the axial direction. When the outer gear and the inner gear are rotated to increase and decrease volumes of a plurality of pump chambers, which are formed between the outer gear and the inner gear, fuel is sequentially drawn into and is sequentially discharged from the pump chambers.

In the patent literature 1, it is assumed that the receiving hole of the inner gear and the contact portion of the coupling extend in the axial direction, and the receiving hole is urged toward a drive rotation side in a circumferential direction upon contacting of the receiving hole with the contact portion, so that the inner gear is rotated.

However, in this structure, when the inner gear is rotated, the first housing component and the second housing component, between which the inner gear is held, may be slid when the first housing component and the second housing component receive a frictional force that is equal to or larger than a certain level. Therefore, the first housing component and the second housing component need to have a predetermined degree of abrasion resistance. Thus, there is very little room for material choice of the pump housing.

CITATION LIST

Patent Literature

PATENT LITERATURE 1: JPH06-123288A

SUMMARY OF INVENTION

The present disclosure is made in view of the above disadvantage, and it is an objective of the present disclosure to provide a fuel pump that allows a higher degree of freedom with respect to the material choice.

A fuel pump of the present disclosure includes:

an outer gear that includes a plurality of internal teeth;

an inner gear that includes a plurality of external teeth and is meshed with the outer gear while the inner gear is eccentric to the outer gear in an eccentric direction, wherein the inner gear includes a receiving hole that extends in an axial direction;

a rotatable shaft that is rotationally driven;

a contact portion that is formed to be contactable with the receiving hole, wherein the contact portion transmits a drive force from the rotatable shaft to the receiving hole to rotate the inner gear; and a pump housing that rotatably receives the outer gear and the inner gear and includes a first housing component and a second housing component, between which the inner gear is held in the axial direction, wherein:

when the outer gear and the inner gear are rotated to a drive rotation side to increase and decrease volumes of a plurality of pump chambers, which are formed between the outer gear and the inner gear, fuel is sequentially drawn into and is sequentially discharged from the plurality of pump chambers;

at least one of the receiving hole and the contact portion includes a tilt surface, which is tilted relative to the axis direction; and when the rotatable shaft is rotated to the drive rotation side, the receiving hole contacts the contact portion through the tilt surface, so that the receiving hole is urged toward the drive rotation side in a circumferential direction and is also urged toward the first housing component in the axial direction.

With the above construction, when the rotatable shaft is rotated toward the drive rotation side, the contact portion contacts the receiving hole, so that the drive force of the rotatable shaft is conducted to the receiving hole to rotate the inner gear. Here, in the structure where the at least one of the receiving hole and the contact portion includes the tilt surface, which is tilted relative to the axial direction, the contact portion urges the receiving hole toward the first housing component in the axial direction in addition to the drive rotation side in the circumferential direction. In this way, the inner gear is slid while the inner gear urges the first housing component among the first housing component and the second housing component of the pump housing. In this way, the occurrence of sliding relative to the second housing component is limited, so that the degree of abrasion resistance, which is required for the second housing component, can be lowered. Therefore, a range of material choice is increased for the second housing component. Thereby, it is possible to provide the fuel pump that enables the high degree of freedom with respect to the material choice.

DESCRIPTION OF EMBODIMENTS

Hereinafter, a plurality of embodiments of the present disclosure will be described with reference to the accompanying drawings. In the respective embodiments, the corresponding constituent elements are indicated by the same reference signs and may not be described redundantly for the sake of simplicity. In a case where only a portion of a structure is described in the respective embodiments, the rest of the structure may be the same as that of another one of the embodiments described earlier. In addition to the explicitly indicated combinations of the structures described in the description of the respective embodiments, the structures of the embodiments may be partially combined even if such a combination is not explicitly described as long as such a combination does not cause any problem.

(First Embodiment)

Figure 1:
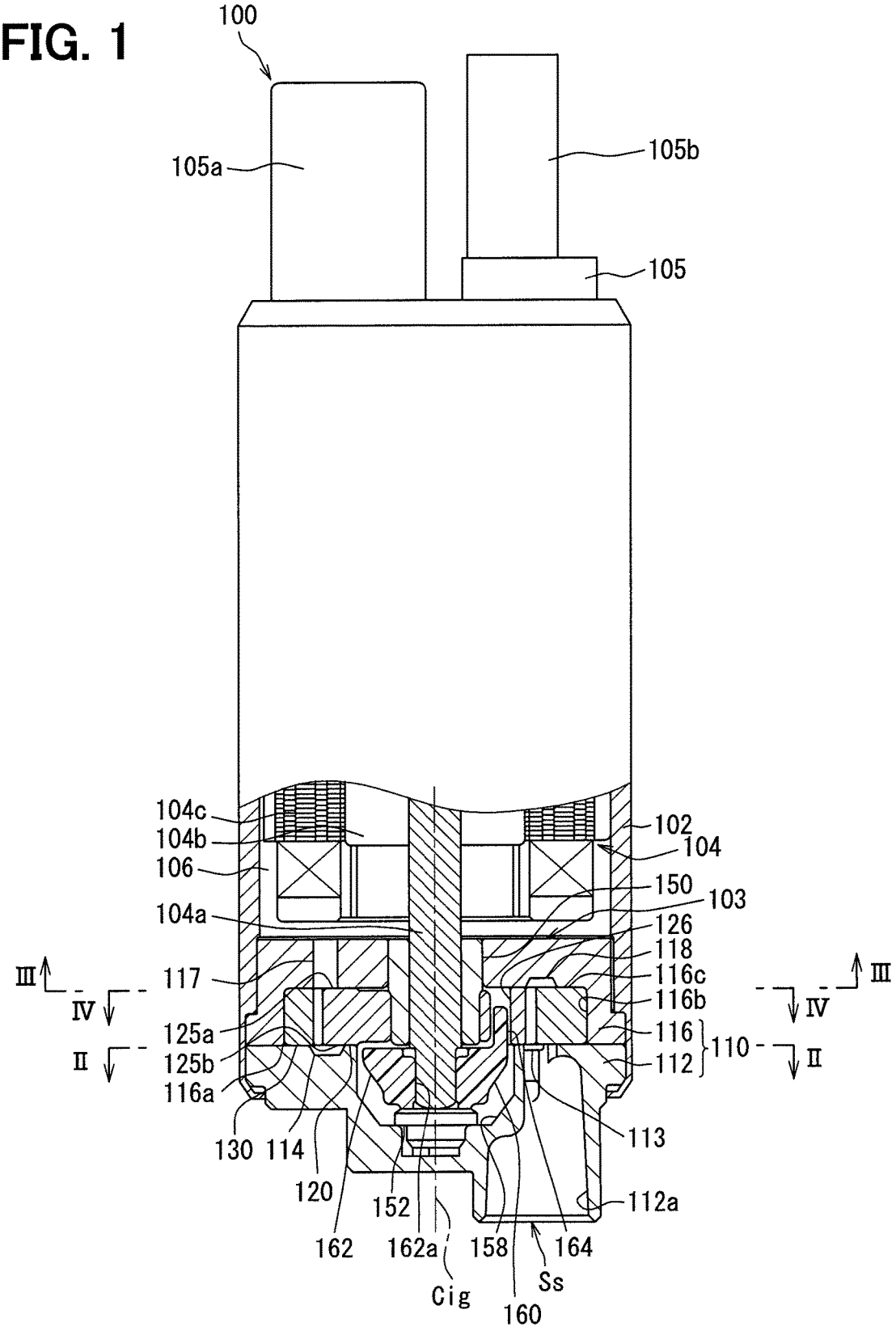
FIG. 1 is a partial cross-sectional view indicating a fuel pump according to a first embodiment of the present disclosure.

As shown in FIG. 1, a fuel pump 100 according to a first embodiment of the present disclosure is a positive displacement trochoid pump that is installed in a vehicle. The fuel pump 100 includes a pump main body 103 and an electric motor 104, which are received in an inside of a pump body 102 that is configured into a cylindrical tubular form. Furthermore, the fuel pump 100 includes a side cover 105. The side cover 105 projects from an end of the pump body 102, which is located on a side of the electric motor 104 that is opposite from the pump main body 103 in the axial direction. In this fuel pump 100, a rotatable shaft 104*a* of the electric motor 104 is rotated when an electric power is supplied from an external circuit through an electric connector 105*a* to energize the electric motor 104. Thus, an outer gear 130 and an inner gear 120 of the pump main body 103 are rotated by a drive force of the rotatable shaft 104*a* of the electric motor 104, and thereby fuel is drawn into and compressed in the fuel pump 100 and is then discharged from the fuel pump 100 through a discharge port 105*b*. The fuel pump 100 pumps light oil (diesel fuel), which has the higher viscosity in comparison to gasoline, as the fuel.

In the present embodiment, the electric motor 104 is an inner gear brushless motor and includes magnets 104*b*, which form four magnetic poles, and coils 104*c*, which are installed in six slots. For example, at a time of turning on of an ignition switch of the vehicle or a time of depressing an accelerator pedal, a positioning control operation of the electric motor 104 is executed to rotate the rotatable shaft 104*a* toward a drive rotation side or a counter-drive rotation side. Thereafter, the electric motor 104 executes a drive control operation, which rotates the rotatable shaft 104*a* from the position, at which the rotatable shaft 104*a* is positioned in the positioning control operation, toward the drive rotation side.

Here, the drive rotation side is a positive direction side of a rotation direction Rig of the inner gear 120 in a circumferential direction of the inner gear 120. The counter-drive rotation side is a negative direction side of the rotation direction Rig of the inner gear 120 in the circumferential direction of the inner gear 120.

Hereinafter, the pump main body 103 will be described in detail. The pump main body 103 includes a pump housing 110, the inner gear 120, the outer gear 130 and a joint member 160. The pump housing 110 includes a pump cover 112 and a pump casing 116, which are stacked one after another.

The pump cover 112 is made of aluminum having high formability and is shaped into a circular disk form. The pump cover 112 axially projects outward from the end part of the pump body 102, which is located on the side of the electric motor 104 that is opposite from the side cover 105.

Figure 2:
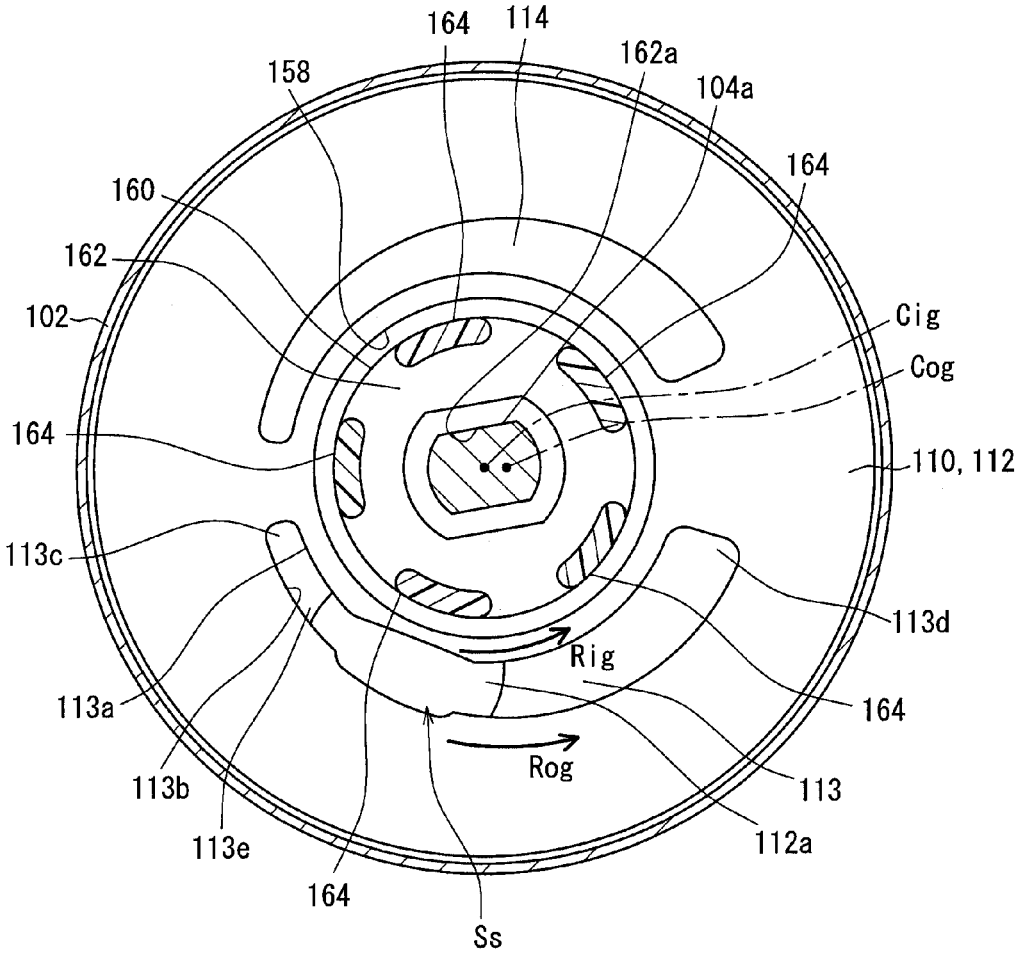
FIG. 2 is a cross-sectional view taken along line II-II in FIG. 1.

In order to draw the fuel from an outside of the fuel pump 100, the pump cover 112 shown in FIGS. 1 and 2 has a suction inlet 112*a*, which is formed as a cylindrical hole, and a suction passage 113, which is shaped into an arcuate form. The suction inlet 112*a* extends through a predetermined opening area Ss of the pump cover 112, which is eccentric to an inner central axis Cig of the inner gear 120, in the axial direction of the pump cover 112. The suction passage 113 opens on the pump casing 116 side of the pump cover 112. As shown in FIG. 2, an inner peripheral portion 113*a* of the suction passage 113 has a circumferential extent, which is less than one half of an entire circumference of the inner gear 120, in the rotation direction Rig of the inner gear 120 (also see FIG. 4). An outer peripheral portion 113*b* of the suction passage 113 has a circumferential extent, which is less than one half of an entire circumference of the outer gear 130, in a rotation direction Rog of the outer gear 130.

The suction passage 113 extends from a start end part 113*c* of the suction passage 113 such that a width of the suction passage 113 progressively increases in the rotation direction toward a terminal end part 113*d* of the suction passage 113. The suction inlet 112*a* opens in a groove bottom portion 113*e* of the suction passage 113 at the opening area Ss, so that the suction passage 113 is communicated with the suction inlet 112*a*. As shown particularly in FIG. 2, in an entire range of the opening area Ss, in which the suction inlet 112*a* opens, the width of the suction passage 113 is set to be smaller than a width of the suction inlet 112*a*.

Furthermore, the pump cover 112 forms an installation space 158 at an area that is opposed to the inner gear 120 along the inner central axis Gig. The installation space 158 is shaped into a recessed hole. A fitting body 162 of the joint member 160 is rotatably installed in the installation space 158.

Figure 3:
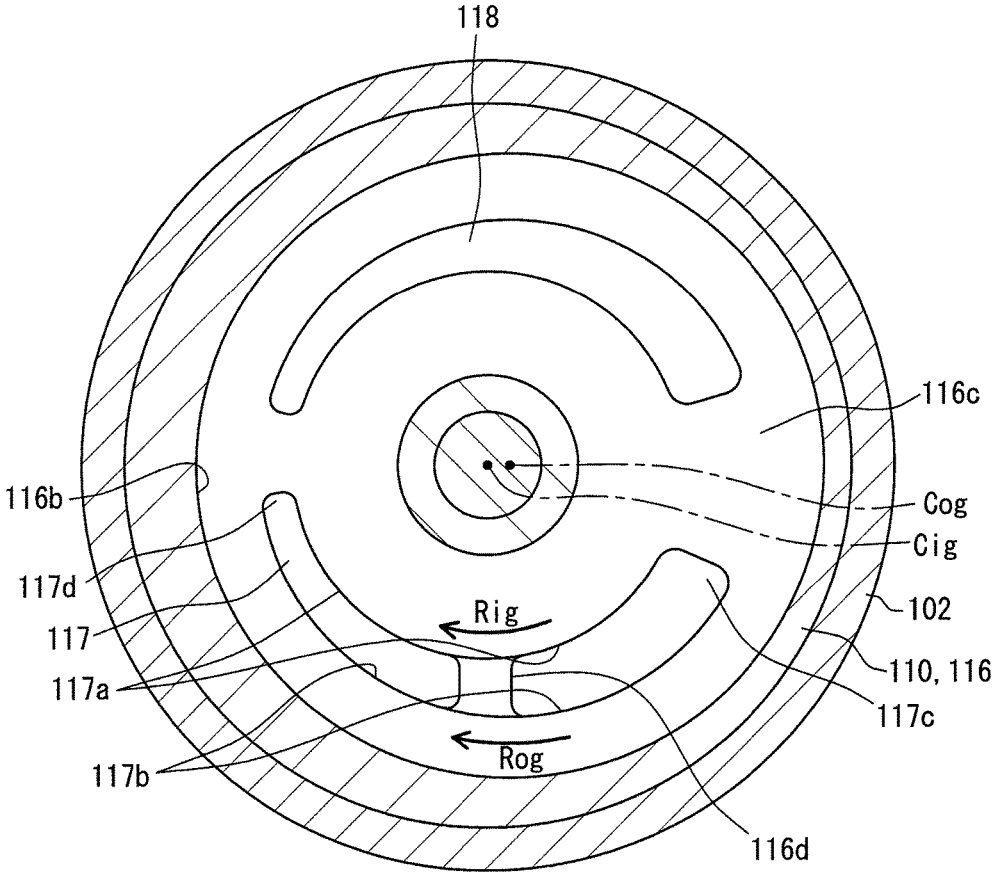
FIG. 3 is a cross-sectional view taken along line III-III in FIG. 1.
Figure 4:
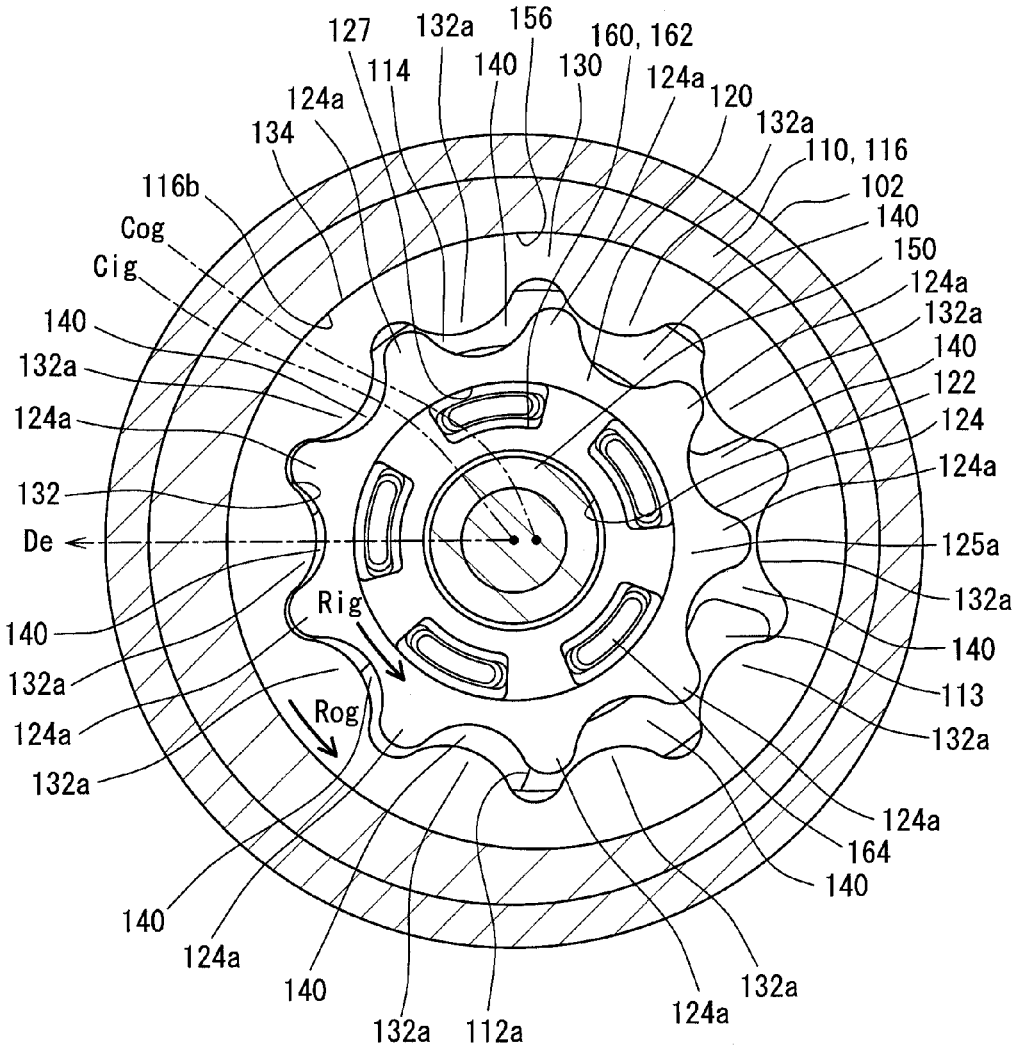
FIG. 4 is a cross-sectional view taken along line IV-IV in FIG. 1.

The pump casing 116 shown in FIGS. 1, 3 and 4 is formed such that a base material made of metal, such as iron, is surface treated with nickel-phosphorus plating, chrome plating, or a DLC (diamond-like carbon) film, so that the pump casing 116 has abrasion resistance and is shaped into a bottomed cylindrical tubular form. An opening portion 116*a* of the pump casing 116 is covered with the pump cover 112 such that an entire circumferential extent of the opening portion 116*a* is tightly closed by the pump cover 112. As shown particularly in FIGS. 1 and 4, an inner peripheral portion 116*b* of the pump casing 116 is formed as a cylindrical hole that is eccentric to the inner central axis Cig of the inner gear 120.

The pump casing 116 forms a discharge passage 117, which is formed as an arcuate hole, to discharge the fuel from the discharge port 105*b* through a fuel passage 106 defined between the pump body 102 and the electric motor 104. The discharge passage 117 axially extends through a recessed bottom portion 116*c* of the pump casing 116. Particularly, as shown in FIG. 3, an inner peripheral portion 117*a* of the discharge passage 117 has a circumferential extent, which is less than one half of the entire circumference of the inner gear 120 in the rotation direction Rig. An outer peripheral portion 117*b* of the discharge passage 117 has a circumferential extent, which is less than one half of an entire circumference of the outer gear 130, in the rotation direction Rog of the outer gear 130. A width of the discharge passage 117 progressively decreases from a start end part 117*c* toward a terminal end part 117*d*.

Furthermore, the pump casing 116 includes a reinforcing rib 116*d* in the discharge passage 117. The reinforcing rib 116*d* is formed integrally with the pump casing 116 such that the reinforcing rib 116*d* extends across the discharge passage 117 in a crossing direction, which crosses the rotation direction Rig of the inner gear 120, and thereby the reinforcing rib 116*d* reinforces the pump casing 116.

A suction groove 118 is formed in the recessed bottom portion 116*c* of the pump casing 116 at a corresponding area that is opposed to the suction passage 113 while pump chambers 140 (described later in detail) are interposed between the suction groove 118 and the suction passage 113 in the axial direction. As shown particularly in FIG. 3, the suction groove 118 is an arcuate groove that corresponds to a shape, which is produced by projecting the suction passage 113 onto the pump casing 116 in the axial direction. In this way, in the pump casing 116, the discharge passage 117 is formed to be symmetric to the suction groove 118 with respect to the symmetry axis located between the discharge passage 117 and the suction groove 118. As shown particularly in FIG. 2, a discharge groove 114 is formed in the pump cover 112 at a corresponding area that is opposed to the discharge passage 117 in the axial direction while the pump chambers 140 are interposed between the discharge groove 114 and the discharge passage 117 in the axial direction. In this way, in the pump cover 112, the suction passage 113 is formed to be symmetric to the discharge groove 114 with respect to the symmetry axis located between the suction passage 113 and the discharge groove 114.

As shown in FIG. 1, a radial bearing 150 is securely fitted to the recessed bottom portion 116*c* of the pump casing 116 along the inner central axis Cig to radially support the rotatable shaft 104*a* of the electric motor 104 in a rotatable manner. Furthermore, a thrust bearing 152 is securely fitted to the pump cover 112 along the inner central axis Cig to axially support the rotatable shaft 104*a* in a rotatable manner.

As shown in FIGS. 1 and 4, a receiving space 156, which receives the inner gear 120 and the outer gear 130, is formed by the recessed bottom portion 116*c* and the inner peripheral portion 116*b* of the pump casing 116 in cooperation with the pump cover 112. In this way, the inner gear 120 and the outer gear 130 are held from the two opposite axial sides by the recessed bottom portion 116*c* of the pump casing 116 and the pump cover 112. The inner gear 120 and the outer gear 130 are trochoid gears, which have a trochoid tooth profile.

Figure 5:
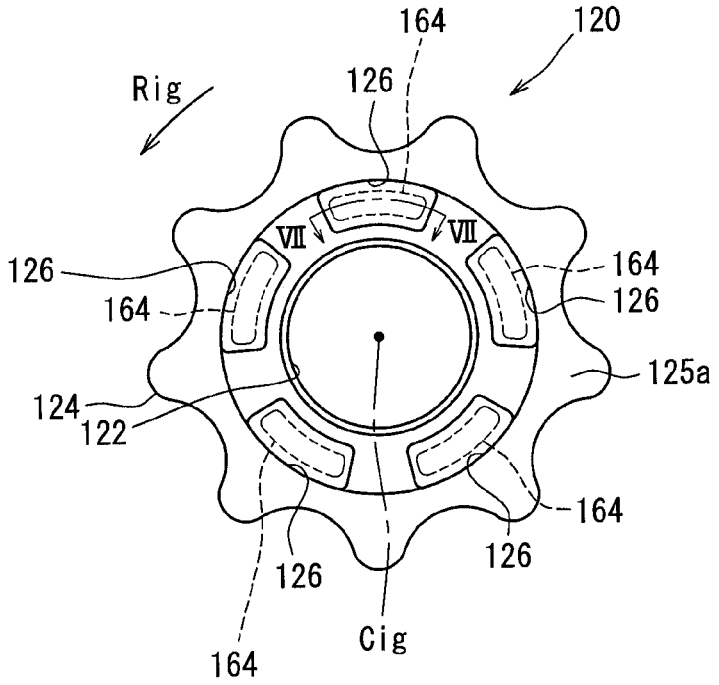
FIG. 5 is a plan view of an inner gear of the first embodiment.
Figure 6:
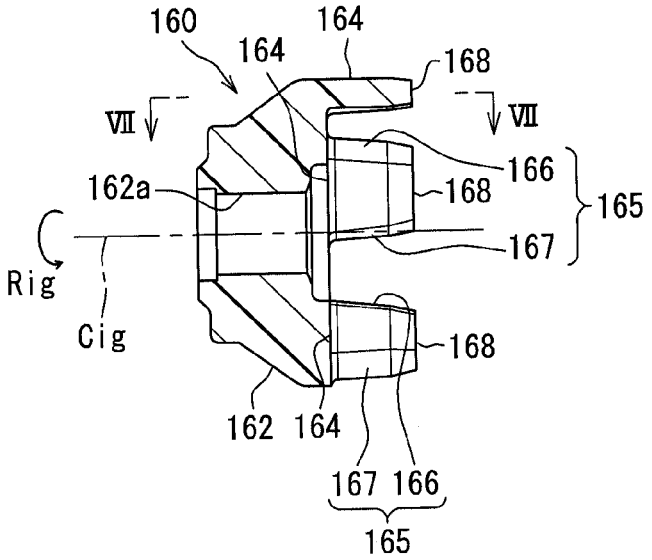
FIG. 6 is a cross-sectional view indicating a joint member of the first embodiment.

The inner gear 120, which is indicated in FIGS. 1, 4 and 5, is centered at the inner central axis Cig and is thereby coaxial with the rotatable shaft 104*a*, so that the inner gear 120 is eccentrically placed in the receiving space 156. An inner peripheral portion 122 of the inner gear 120 is radially supported in a rotatable manner by the radial bearing 150. Furthermore, two bearing surfaces 125*a*, 125*b* of the inner gear 120, which are respectively formed at two opposed axial ends of the inner gear 120, are supported in a rotatable manner by the recessed bottom portion 116*c* of the pump casing 116 and the pump cover 112, respectively.

The inner gear 120 has receiving holes 126, which extend in the axial direction at a location that is opposed to the installation space 158, in which the fitting body 162 of the joint member 160 is placed. The receiving holes 126 of the present embodiment are provided as a plurality (five in the present embodiment) of receiving holes 126 that are arranged one after another at equal intervals in the circumferential direction along the rotation direction Rig. Each of the receiving holes 126 extends through the inner gear 120 to the recessed bottom portion 116*c* side. Insertion bodies 164 of the joint member 160 are inserted into the receiving holes 126, respectively, to transmit the drive force of the rotatable shaft 104*a* to the inner gear 120 through the joint member 160.

The inner gear 120 includes a plurality of external teeth 124*a*, which are formed in an outer peripheral portion 124 of the inner gear 120 and are arranged one after another at equal intervals in the circumferential direction, i.e., the rotation direction Rig. Each of the external teeth 124*a* can axially oppose the passages 113, 117 and the grooves 114, 118 in response to the rotation of the inner gear 120. Thereby, it is possible to limit sticking of the inner gear 120 to the recessed bottom portion 116*c* and the pump cover 112. The inner gear 120 is rotatable in the rotation direction Rig about the inner central axis Cig.

As shown in FIGS. 1 and 4, the outer gear 130 is eccentric to the inner central axis Cig of the inner gear 120, so that the outer gear 130 is coaxially received in the receiving space 156. In this way, the inner gear 120 is eccentric to the outer gear 130 in an eccentric direction De, which is a radial direction. An outer peripheral portion 134 of the outer gear 130 is rotatably supported from a radially outer side by the inner peripheral portion 116*b* of the pump casing 116. Furthermore, the outer peripheral portion 134 of the outer gear 130 is axially supported in a rotatable manner from two opposite axial sides by the recessed bottom portion 116*c* of the pump casing 116 and the pump cover 112. The outer gear 130 is rotatable in the rotation direction Rog about an outer central axis Cog, which is eccentric to the inner central axis Cig.

The outer gear 130 has a plurality of internal teeth 132*a*. The internal teeth 132*a* are formed in an inner peripheral portion 132 of the outer gear 130 and are arranged one after another at equal intervals in the rotation direction Rog. The number of the internal teeth 132*a* of the outer gear 130 is set to be larger than the number of the external teeth 124*a* of the inner gear 120 by one. Each of the internal teeth 132*a* can axially oppose the passages 113, 117 and the grooves 114, 118 in response to the rotation of the outer gear 130. Thereby, it is possible to limit sticking of the outer gear 130 to the recessed bottom portion 116*c* and the pump cover 112.

The inner gear 120 is meshed with the outer gear 130 due to the eccentricity of the inner gear 120 relative to the outer gear 130 in the eccentric direction De. With this configuration, the pump chambers 140 are continuously formed one after another between the gears 120, 130 in the receiving space 156. A volume of each pump chamber 140 is increased and decreased when the outer gear 130 and the inner gear 120 are rotated.

The volume of each of opposing ones of the pump chambers 140, which are axially opposed to and communicated with the suction passage 113 and the suction groove 118, is increased in response to the rotation of the gears 120, 130. Thereby, the fuel is drawn from the suction inlet 112*a* into the corresponding pump chambers 140 through the suction passage 113. At this time, since the width of the suction passage 113 progressively increases from the start end part 113*c* to the terminal end part 113*d* (also see FIG. 2), the amount of fuel drawn into the pump chamber 140 through the suction passage 113 corresponds to the amount of increase in the volume of the pump chamber 140.

The volume of each of opposing ones of the pump chambers 140, which are axially opposed to and communicated with the discharge passage 117 and the discharge groove 114, is decreased in response to the rotation of the gears 120, 130. Therefore, simultaneously with the suctioning function discussed above, the fuel is discharged from the corresponding pump chamber 140 into the fuel passage 106 through the discharge passage 117. At this time, since the width of the discharge passage 117 progressively decreases from the start end part 117*c* toward the terminal end part 117*d* (also see FIG. 3), the amount of fuel discharged from the pump chamber 140 through the discharge passage 117 corresponds to the amount of decrease in the volume of the pump chamber 140.

Thereby, in the fuel pump 100, the fuel is sequentially drawn into the respective pump chambers 140 and is thereafter sequentially discharged from the respective pump chambers 140.

With reference to FIGS. 1, 2, 4 and 6, the joint member 160 is made of synthetic resin, such as polyphenylene sulfide (PPS). The joint member 160 relays the drive force of the rotatable shaft 104*a* to the inner gear 120 to rotate the inner gear 120 in the rotation direction Rig. The joint member 160 includes the fitting body 162 and the insertion bodies 164, which are formed integrally as a one-piece body.

The fitting body 162 is installed in the installation space 158, which is formed in the pump cover 112. A fitting hole 162*a* is formed in a center of the fitting body 162, and thereby the fitting body 162 is shaped into a circular ring form. When the rotatable shaft 104*a* is fitted into the fitting hole 162*a*, the fitting body 162 is securely fitted to the rotatable shaft 104*a*.

The number of the insertion bodies 164 corresponds to the number of the receiving holes 126 of the inner gear 120. Specifically, in order to reduce the influence of the torque ripple of the electric motor 104, the number of the insertion bodies 164 is different from the number of the magnetic poles and the number of the slots of the electric motor 104. In the present embodiment, the number of the insertion bodies 164 is particularly set to five, which is a prime number. The insertion bodies 164 axially extend from a plurality of locations, respectively, on a radially outer side of the fitting hole 162*a*, and the insertion bodies 164 are respectively resiliently deformably formed. The insertion bodies 164 are arranged one after another at equal intervals in the circumferential direction. Each insertion body 164 has a contact portion 165 that is inserted into the corresponding receiving hole 126 and is formed to be contactable with the corresponding receiving hole 126. The contact portion 165 conducts the drive force of the rotatable shaft 104*a* to the receiving hole 126 to rotate the inner gear 120 through the contact of the contact portion 165 to the receiving hole 126.

Figure 7:
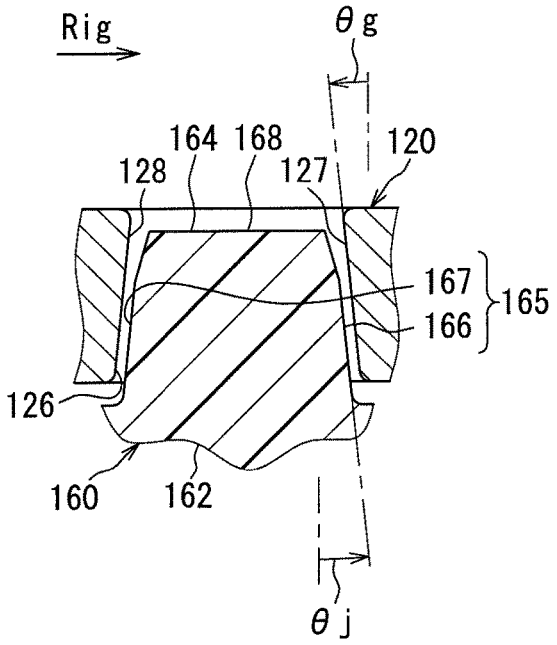
FIG. 7 is a diagram for describing a relationship between a receiving hole and a contact portion according to the first embodiment, corresponding to a cross sectional view taken along line VII-VII in FIG. 5 or 6.

Now, the relationship between the receiving hole 126 and the contact portion 165 will be described in detail with reference to FIG. 7. In the following discussion, although one set of the receiving hole 126 and the contact portion 165, which are related with each other, is described, the following discussion is also equally applicable to the other sets of the receiving holes 126 and the contact portions 165.

In the first embodiment, the receiving hole 126 includes a receiving-side tilt surface 127 that serves as a tilt surface, which is tilted relative to the axial direction. The receiving-side tilt surface 127 is in a form of a planar surface that is located at a drive rotation side in an inner wall of the receiving hole 126 and faces a counter-drive rotation side. The receiving-side tilt surface 127 extends in a radial direction and is tilted relative to the axial direction such that the receiving-side tilt surface 127 is progressively tilted from the pump cover 112 side to the pump casing 116 side toward the counter-drive rotation side.

The contact portion 165 includes a contacting-side tilt surface 166 that serves as a tilt surface, which is tilted relative to the axial direction. The contacting-side tilt surface 166 is formed to oppose the receiving-side tilt surface 127 and is in a form of cylindrical surface or a conical surface that faces the drive rotation side. The contacting-side tilt surface 166 is tilted relative to the axial direction such that the contacting-side tilt surface 166 is progressively tilted from the pump cover 112 side to the pump casing 116 side toward the counter-drive rotation side.

The receiving-side tilt surface 127 is tilted along the contacting-side tilt surface 166, and a tilt angle θg of the receiving-side tilt surface 127 relative to the axial direction and a tilt angle θj of the contacting-side tilt surface 166 relative to the axial direction are set to be substantially equal to each other. Furthermore, in order to avoid contact of a distal end of the insertion body 164 with the receiving hole, it is preferred that the tilt angle θg is equal to or smaller than the tilt angle θj.

The receiving hole 126 further includes a receiving-side counter-tilt surface 128 that serves as a counter-tilt surface, which is tilted oppositely relative to the receiving-side tilt surface 127. The receiving-side counter-tilt surface 128 is in a form of a planar surface that is located at the counter-drive rotation side in the inner wall of the receiving hole 126 and faces the drive rotation side. The receiving-side counter-tilt surface 128 extends in the radial direction and is tilted relative to the axial direction such that the receiving counter-tilt surface 128 is progressively tilted from the pump cover 112 side to the pump casing 116 side toward the drive rotation side.

The contact portion 165 further includes a contacting-side counter-tilt surface 167 that serves as a counter-tilt surface, which is tilted oppositely relative to the contacting-side tilt surface 166. The contacting-side counter-tilt surface 167 is formed to oppose the receiving-side counter-tilt surface 128 and is in a form of cylindrical surface or a conical surface that faces the counter-drive rotation side. The contacting-side counter-tilt surface 167 is tilted relative to the axial direction such that the contacting-side counter-tilt surface 167 is progressively tilted from the pump cover 112 side to the pump casing 116 side toward the drive rotation side.

A guide portion 168 is formed on a distal end side of the contacting-side tilt surface 166 and the contacting-side counter-tilt surface 167 in the insertion body 164. A tilt angle of the guide portion 168 relative to the axial direction is set to be larger than that of the contacting-side tilt surface 166 and that of the contacting-side counter-tilt surface 167 to ease assembling of the joint member 160 to the receiving holes 126 at the time of manufacturing.

When the rotatable shaft 104*a* is rotated toward the drive rotation side, the insertion body 164 is moved toward the drive rotation side. Thereby, the receiving-side tilt surface 127 contacts the contacting-side tilt surface 166. Because of the contact through the receiving-side tilt surface 127 and the contacting-side tilt surface 166, the receiving hole 126 is urged toward the pump casing 116 side in the axial direction in addition to the drive rotation side in the circumferential direction. Specifically, the receiving hole 126 is urged toward the recessed bottom portion 116*c*.

Furthermore, in the positioning control operation of the electric motor 104, for example, when the rotatable shaft 104*a* is rotated toward the counter-drive rotation side, the insertion body 164 is moved toward the counter-drive rotation side. Thereby, the receiving-side counter-tilt surface 128 contacts the contacting-side counter-tilt surface 167. Because of the contact through the receiving-side counter-tilt surface 128 and the contacting-side counter-tilt surface 167, the receiving hole 126 is urged toward the pump casing 116 side in the axial direction in addition to the counter-drive-rotation side in the circumferential direction. Specifically, the receiving hole 126 is urged toward the recessed bottom portion 116*c*.

Thereby, the inner gear 120 can rotate in the circumferential direction about the inner central axis Cig in response to the rotation of the rotatable shaft 104*a* of the electric motor 104, while the bearing surface 125*a* is slid relative to the pump casing 116.

In the present embodiment, the pump casing 116 serves as a first housing component, and the pump cover 112 serves as a second housing component.

(Advantages)

Hereinafter, advantages of the first embodiment will be described.

According to the first embodiment, when the rotatable shaft 104*a* is rotated toward the drive rotation side, the contact portions 165 contact the receiving holes 126, respectively. Thus, the drive force of the rotatable shaft 104*a* is conducted to the receiving holes 126, and thereby the inner gear 120 is rotated. Here, in the case of the structure where at least one of the receiving hole 126 and the contact portion 165 includes the tilt surface 127, 166 that is tilted relative to the axial direction, the contact portion 165 urges the receiving hole 126 toward the pump casing 116 side in the axial direction in addition to the drive rotation side in the circumferential direction. In this way, the inner gear 120 is slid while the inner gear 120 urges the pump casing 116 among the pump casing 116 and the pump cover 112 of the pump housing 110. In this way, the occurrence of sliding relative to the pump cover 112 is limited, so that the degree of abrasion resistance, which is required for the pump cover 112, can be lowered. Therefore, a range of material choice is increased for the pump cover 112. Thereby, it is possible to provide the fuel pump 100 that enables the high degree of freedom with respect to the material choice.

Furthermore, according to the first embodiment, there is provided the joint member 160 that relays the drive force of the rotatable shaft 104*a* to the inner gear 120. In the joint member 160, the fitting body 162, which is fitted to the rotatable shaft 104*a*, and the insertion bodies 164, which project from the fitting body 162 and are respectively inserted into the receiving holes 126, are integrally formed as the one-piece body, and the contact portion 165 is formed in each insertion body 164. With the above construction, when the rotatable shaft 104*a* is rotated in the drive rotation direction, the contact portion 165 of each insertion body 164, which is inserted into the corresponding receiving hole 126, can reliably contact the receiving hole 126, and thereby the contact portion 165 of the insertion body 164 can urge the receiving hole 126 toward the pump casing 116 side in the axial direction. Therefore, the degree of abrasion resistance, which is required for the pump cover 112, can be lowered, and the degree of freedom with respect to the material choice can be increased.

Furthermore, according to the first embodiment, the contact portion 165 includes the contacting-side tilt surface 166, which is tilted relative to the axial direction, and the receiving hole 126 includes the receiving-side tilt surface 127, which is tilted along the contacting-side tilt surface 166. Since the contacting-side tilt surface 166 makes the surface contact with the receiving-side tilt surface 127, which extends along the contacting-side tilt surface 166, the receiving hole 126 can be urged toward the pump casing 116 side in the axial direction while avoiding the concentration of the stress.

Furthermore, according to the first embodiment, the pump casing 116 has the abrasion resistance and is shaped into a bottomed tubular form that rotatably supports the outer gear 130 from the radially outer side of the outer gear 130, and the receiving hole 126 is urged toward the recessed bottom portion 116*c* of the pump casing 116. When the volumes of the pump chambers 140, which are formed between the gears 120, 130, are increased and decreased, the outer gear 130 receives the pressure from the fuel in the radial direction. Thereby, the outer peripheral portion 134 of the outer gear 130 is slid relative to the pump housing 110. In this case, since the pump casing 116, which is shaped into the bottomed tubular form, rotatably supports the outer gear 130 from the radially outer side of the outer gear 130, the durability of the pump housing 110 is improved. At the same time, the required degree of the abrasion resistance of the component 112, which is other than the pump casing 116, is lowered, so that the degree of freedom with respect to the material choice is improved.

Furthermore, according to the first embodiment, at least one of the receiving hole 126 and the contact portion 165 includes the counter-tilt surface 128, 167, which is tilted oppositely relative to the tilt surface 127, 166. When the rotatable shaft 104*a* is rotated toward the counter-drive rotation side, the receiving hole 126 contacts the contact portion 165 through the counter-tilt surfaces 128, 167. Thereby, the receiving hole 126 is urged toward the pump casing 116 side in the axial direction in addition to the counter-drive rotation side in the circumferential direction. Accordingly, even in the case where the rotatable shaft 104*a* is rotated toward the counter-drive rotation side due to, for example, the positioning control operation at the start-up time, the receiving hole 126 is urged toward the same side as that of the case where the rotatable shaft 104*a* is rotated toward the drive rotation side. Therefore, the occurrence of sliding relative to the pump cover 112 can be reliably limited. Therefore, the degree of abrasion resistance, which is required for the pump cover 112, can be lowered, and the degree of freedom with respect to the material choice can be increased.

(Second Embodiment)

Figure 8:
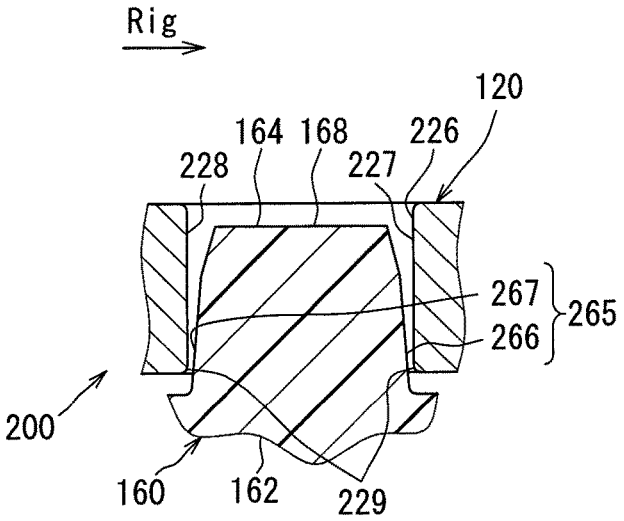
FIG. 8 is a diagram, which corresponds to FIG. 7, showing a second embodiment.

As shown in FIG. 8, a second embodiment of the present disclosure is a modification of the first embodiment. The second embodiment will be described mainly with respect to differences, which are different from the first embodiment.

A relationship between the receiving hole 226 and the contact portion 265 in the fuel pump 200 of the second embodiment will be described in detail. In the following discussion, although one set of the receiving hole 226 and the contact portion 265, which are related with each other, is described, the following discussion is also equally applicable to the other sets of the receiving holes 226 and the contact portions 265.

The joint member 160 of the second embodiment is shaped into the form that is similar to that of the first embodiment. The contact portion 265, which is formed at the insertion body 164 of the joint member 160, includes a contacting-side tilt surface 266 that serves as a tilt surface, which is tilted relative to the axial direction. The contacting-side tilt surface 266 is partially received in the receiving hole 226 and is in a form of cylindrical surface or a conical surface that faces the drive rotation side. The contacting-side tilt surface 266 is tilted relative to the axial direction such that the contacting-side tilt surface 266 is progressively tilted from the pump cover 112 side to the pump casing 116 side toward the counter-drive rotation side.

The receiving hole 226 is different from that of the first embodiment. Specifically, the receiving hole 226 includes an axially extending surface 227, which extends in the axial direction, at the location that is at the drive rotation side in the inner wall of the receiving hole 226 and is opposed to the contacting-side tilt surface 266. Furthermore, the receiving hole 226 includes an opening portion 229 at an edge portion of the axially extending surface 227, which is located on the pump cover 112 side. The opening portion 229 is opposed to the fitting body 162 like in the first embodiment. The opening portion 229 is shaped into a protruding curved form and is opposed to the contacting-side tilt surface 266.

The contact portion 265 further includes a contacting-side counter-tilt surface 267 that serves as a counter-tilt surface, which is tilted oppositely relative to the contacting-side tilt surface 266. The contacting-side counter-tilt surface 267 is partially received in the receiving hole 226 and is in a form of a cylindrical surface or a conical surface that faces the counter-drive rotation side. The contacting-side counter-tilt surface 267 is tilted relative to the axial direction such that the contacting-side counter-tilt surface 267 is progressively tilted from the pump cover 112 side to the pump casing 116 side toward the drive rotation side.

The receiving hole 226 further includes an axially extending surface 228, which extends in the axial direction, at a location that is opposed to the contacting-side counter-tilt surface 267. The receiving hole 226 also includes the opening portion 229 at an edge portion of the axially extending surface 228, which is located on the pump cover 112 side.

When the rotatable shaft 104*a* is rotated toward the drive rotation side, the insertion body 164 is moved toward the drive rotation side. Thereby, the opening portion 229 contacts the contacting-side tilt surface 266. Because of the contact through the opening portion 229 and the contacting-side tilt surface 266, the receiving hole 226 is urged toward the pump casing 116 side in the axial direction in addition to the drive rotation side in the circumferential direction. Specifically, the receiving hole 226 is urged toward the recessed bottom portion 116*c*.

Furthermore, in the positioning control operation of the electric motor 104, for example, when the rotatable shaft 104*a* is rotated toward the counter-drive rotation side, the insertion body 164 is moved toward the counter-drive rotation side. Thereby, the opening portion 229 contacts the contacting-side counter-tilt surface 267. Because of the contact through the opening portion 229 and the contacting-side counter-tilt surface 267, the receiving hole 226 is urged toward the pump casing 116 side in the axial direction in addition to the counter-drive-rotation side in the circumferential direction. Specifically, the receiving hole 226 is urged toward the recessed bottom portion 116*c*.

Even in the second embodiment described above, because of the relationship between the receiving hole 226 and the contact portion 265, the advantages, which are similar to those of the first embodiment, can be achieved.

Furthermore, according to the second embodiment, there is provided the joint member 160 that relays the drive force of the rotatable shaft 104*a* to the inner gear 120. In the joint member 160, the fitting body 162, which is fitted to the rotatable shaft 104*a*, and the insertion bodies 164, which project from the fitting body 162 and are respectively inserted into the receiving holes 226, are integrally formed as the one-piece body. The contact portion 265 is formed in each insertion body 164 and has the contacting-side tilt surface 266, which is tilted relative to the axial direction, and each of the receiving holes 226 has the opening portion 229 that is opposed to the fitting body 162 while the receiving hole 226 is urged through the opening portion 229. With this construction, in the inserted state where the contact portion 265 of the insertion body 164 is inserted into the receiving hole 226, the contacting-side tilt surface 266 and the opening portion 229 of the receiving hole 226 contact with each other. Thereby, the contact portion 265 can urge the receiving hole 226 toward the pump casing 116 side in the axial direction while improving the durability of the contact portion 265 by making a contact with the opening portion 229 at the location that is adjacent to the fitting body 162.

(Other Embodiments)

The embodiments of the present disclosure have been described. However, the present disclosure should not be limited to these embodiments, and the present disclosure may be applied to various embodiments and combinations of the embodiments within the scope of the present disclosure.

Specifically, as a first modification, the material of the pump cover 112, which serves as the second housing component, may be selected in view of, for example, the costs besides the formability. Specifically, the pump cover 112 may be made of synthetic resin or a sintered body without applying metal plating thereto.

As a second modification, the pump casing 116, which serves as the first housing component, may be shaped into another shape, such as a circular disk form, which is other than the bottomed tubular form. For example, the pump cover 112 may be shaped into a bottomed tubular form. Furthermore, for example, at the pump housing 110, another component that rotatably supports the outer gear 130 from a radially outer side of the outer gear 130 may be further provided besides the pump casing 116 and the pump cover 112.

Figure 9:
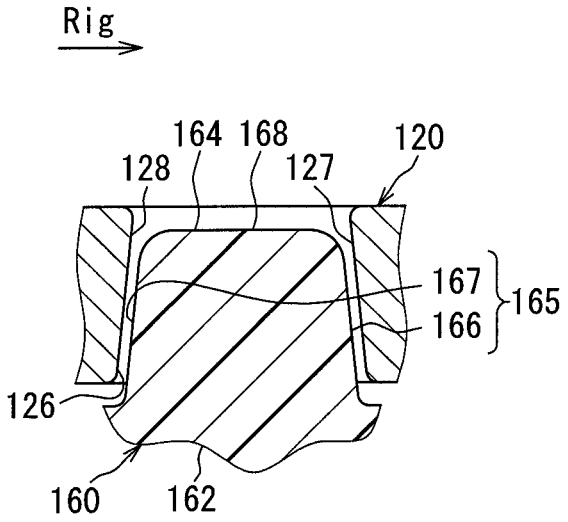
FIG. 9 is a diagram, which corresponds to FIG. 7, showing a third modification.

As a third modification, as shown in FIG. 9, a guide portion 168, which has a curved surface that is in a form of a protruding curved surface, may be formed at a distal end side of the contacting-side tilt surface 166 and the contacting-side counter-tilt surface 167 in the insertion body 164.

As a fourth modification, the guide portion 168 may not be formed at the distal end side of the contacting-side tilt surface 166 and the contacting-side counter-tilt surface 167 in the insertion body 164.

Figure 10:
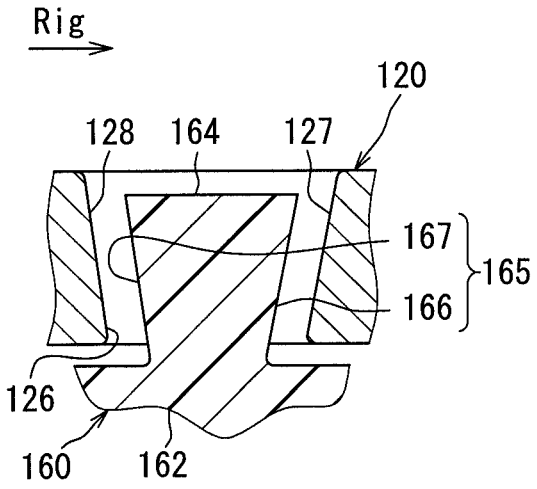
FIG. 10 is a diagram, which corresponds to FIG. 7, showing a fifth modification.

As a fifth embodiment, the pump cover 112 may be constructed to correspond to the first housing component, and the pump casing 116 may be constructed to correspond to the second housing component. As an example, in FIG. 10, the receiving-side tilt surface 127 and the contacting-side tilt surface 166 are tilted relative to the axial direction such that the receiving-side tilt surface 127 and the contacting-side tilt surface 166 are progressively tilted from the pump cover 112 side to the pump casing 116 side toward the drive rotation side. Because of the contact through the receiving-side tilt surface 127 and the contacting-side tilt surface 166 in response to the rotation of the rotatable shaft

104*a* toward the drive rotation side, the receiving hole 126 is urged toward the pump cover 112 side in the axial direction in addition to the drive rotation side in the circumferential direction.

Figure 11:
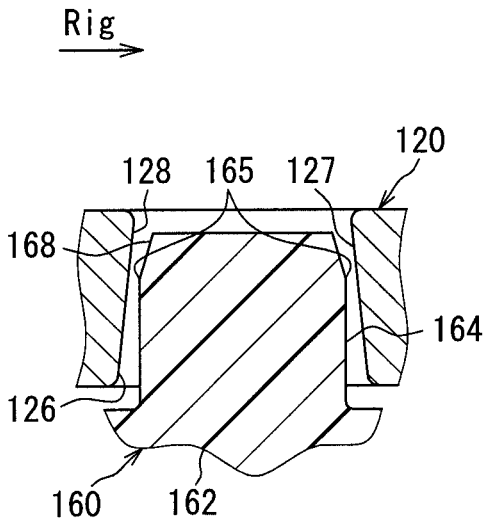
FIG. 11 is a diagram, which corresponds to FIG. 7, showing a sixth modification.

As a sixth modification, as long as at least one of the receiving hole 126 and the contact portion 165 has the tilt surface, the contact portion 165 may not have the contacting-side tilt surface 166. As an example, in FIG. 11, the receiving hole 126 has the receiving-side tilt surface 127 as the tilt surface that is tilted relative to the axial direction. Because of the contact through the receiving-side tilt surface 127 and the contact portion 165 at the distal end side of the insertion body 164 in response to the rotation of the rotatable shaft 104*a* toward the drive rotation side, the receiving hole 126 is urged toward the pump casing 116 side in the axial direction in addition to the drive rotation side in the circumferential direction.

As a seventh modification, both of the receiving hole 126 and the contact portion 165 may not have the counter-tilt surface 128, 167 that is tilted oppositely relative to the tilt surface.

As an eighth modification, at all of the pairs of the receiving holes 126 and the contact portions 165, at least one of the receiving hole 126 and the contact portion 165 may not have the tilt surface 127, 166. However, in the case where the number of the pairs of the receiving holes 126 and the contact portions 165 is five like in the first and second embodiments, it is desirable that a plurality (preferably three or more) of these pairs are formed such that at least one of the receiving hole 126 and the contact portion 165 has the tilt surface 127, 166.

As a ninth modification, the fuel pump 100 may draw and discharge the gasoline or another type of liquid fuel, which is equivalent to the gasoline, besides the light oil, as the fuel.

The invention claimed is:

1. A fuel pump comprising:

an outer gear that includes a plurality of internal teeth;

an inner gear that includes a plurality of external teeth and is meshed with the outer gear while the inner gear is eccentric to the outer gear in an eccentric direction, wherein the inner gear includes a receiving hole that extends in an axial direction;

a rotatable shaft that is rotationally driven;

a contact portion that is formed to be contactable with the receiving hole, wherein the contact portion transmits a drive force from the rotatable shaft to the receiving hole to rotate the inner gear; and a pump housing that rotatably receives the outer gear and the inner gear and includes a first housing component and a second housing component, between which the inner gear is held in the axial direction, wherein:

when the outer gear and the inner gear are rotated to a drive rotation side to increase and decrease volumes of a plurality of pump chambers, which are formed between the outer gear and the inner gear, fuel is sequentially drawn into and is sequentially discharged from the plurality of pump chambers;

at least one of the receiving hole and the contact portion includes a tilt surface, which is tilted relative to the axis direction; and when the rotatable shaft is rotated to the drive rotation side, the receiving hole contacts the contact portion through the tilt surface, so that the receiving hole is urged toward the drive rotation side in a circumferential direction and is also urged toward the first housing component in the axial direction; and the fuel pump further comprising a joint member that includes a fitting body, which is fitted to the rotatable shaft, and an insertion body, which projects from the fitting body and is inserted into the receiving hole, while the fitting body and the insertion body are integrally formed, and the joint member relays between the rotatable shaft and the inner gear, wherein the contact portion is formed in the inserting body.

2. The fuel pump according to claim 1, wherein:

the contact portion includes a contact-side tilt surface as the tilt surface;

the receiving hole includes a receiving-side tilt surface, which is tilted along the contact-side tilt surface, as the tilt surface.

3. The fuel pump according to claim 1, wherein:

the contact portion includes a contact-side tilt surface, as the tilt surface; and the receiving hole includes an opening portion, which is opposed to the fitting body, while the receiving hole is urged through the opening portion.

4. The fuel pump according to claim 1, wherein:

the first housing component has abrasion resistance and is shaped into a bottomed tubular form that rotatably supports the outer gear from a radially outer side of the outer gear; and the receiving hole is urged toward a recessed bottom portion of the first housing component.

5. The fuel pump according to claim 1, wherein:

at least one of the receiving hole and the contact portion includes a counter-tilt surface, which is tilted oppositely from the tilt surface; and when the rotatable shaft is rotated toward a counter-drive rotation side, the receiving hole contacts the contact portion through the counter-tilt surface, so that the receiving hole is urged toward the counter-drive rotation side in the circumferential direction and is also urged toward the first housing component in the axial direction.

* * * * *